US007708041B1

(12) United States Patent
Troesser

(10) Patent No.: US 7,708,041 B1
(45) Date of Patent: May 4, 2010

(54) COMPONENT MILL FOR WOODEN CONSTRUCTION COMPONENTS

(76) Inventor: Kevin M. Troesser, 3100 Dogwood Dr., Fulton, MO (US) 65251

( * ) Notice: Subject to any disclaimer, the term of this patent is extended or adjusted under 35 U.S.C. 154(b) by 1280 days.

(21) Appl. No.: 11/213,618

(22) Filed: Aug. 26, 2005

Related U.S. Application Data

(60) Provisional application No. 60/604,766, filed on Aug. 26, 2004.

(51) Int. Cl.
*B27B 31/00* (2006.01)

(52) U.S. Cl. ..... 144/363; 144/371; 144/3.1; 144/134.1; 144/246.1

(58) Field of Classification Search ..... 144/134.1, 144/135.2, 135.3, 1.1, 2.1, 3.1, 246.1, 248.6, 144/359, 360, 363, 371; 409/182, 189, 190
See application file for complete search history.

(56) References Cited

U.S. PATENT DOCUMENTS 5,730,195 A * 3/1998 Riesmeier et al. ..... 144/134.1
5,915,429 A * 6/1999 Pelletier et al. ..... 144/39
6,817,392 B2 * 11/2004 Phillips ..... 144/39
6,923,227 B2 * 8/2005 Robitaille ..... 144/176

* cited by examiner

*Primary Examiner*—Shelley Self
(74) *Attorney, Agent, or Firm*—Jonathan A. Bay

(57) ABSTRACT

A component mill for producing wooden construction components has a pair of input rollers spaced from a pair of output rollers, wherein each comprises a pair of vertically-stacked pinch rollers. The mill has an overhead X- and Y-axis track system for scrolling a high speed router bit dangling underneath a high speed motor in X- and Y-directions as the input and/or output rollers pass a board for trimming by the spinning, and perhaps scrolling and not stationed still, router bit. A control system controls the input and output rollers, and X- and Y-axis track system in concert to form a selected design of a wooden construction component output from an inputted board.

7 Claims, 4 Drawing Sheets

COMPONENT MILL FOR WOODEN CONSTRUCTION COMPONENTS

CROSS-REFERENCE TO PROVISIONAL APPLICATION(S)

This application claims the benefit of U.S. Provisional Application No. 60/604,766, filed Aug. 26, 2004, the disclosure of which is incorporated herein by this reference.

BACKGROUND AND SUMMARY OF THE INVENTION

The invention relates to cutting devices and more particularly to a cutting device that accepts programmable control instructions to produce wooden construction components of various designs.

Such various designs include without limitation the sawtooth pattern of wooden stair stringers (not shown), or the components of wooden trusses and so on. FIG. 1 shows a representative gable truss 20. Nowadays these assemblies 20 as well as their wooden components are mass produced in assembly line fashion. This truss 20 comprises a straight bottom chord 22, a symmetric pattern of assorted webs 23, an opposite pair of inclined top chords 24, and then all the junctions therebetween are fixed together by pressed-in nail plates 25. The top chords 24 have bottom ends formed with a seat 27 and a butt 28 (eg., as in for abutting a stop).

It is popular to cut the seat 27 and butt 28 with a saw machine (not shown). To do so in optimized mass-production fashion, preferably the saw machine will have two circular saws stationed at different stations relative the longitudinal run of the conveyance path. Lumber stock is sawed as it is conveyed past the saw stations.

The lumber stock is typically conveyed along the conveyance path in the following fashion. Briefly, a single board is understood needless to say as being elongated between two spaced ends and having two opposite broad sides (eg., indicated by reference character B in FIG. 2) between two opposite narrow sides (eg., indicated by reference character N in FIG. 2). Hence, a single board will be stood erect on one narrow side N, advancing forward down the longitudinal run with one broad side B leading, the opposite ends being carried along spaced longitudinal lanes on the opposite lateral sides of the conveyance path. A succession of boards will appear like flights on a flight conveyor. By conveying the lumber stock this way, the board ends hang out over the opposite lateral edges of the conveyance path, and can be conveyed past work stations where, among other things, they might be conveyed past waiting circular-saw blades.

Ordinarily, both circular saws on a saw machine will be adjustable such that their drive spindles can be inclined in various angles in a lateral plane. To cut the seat 27, one saw blade will have to be oriented to spin a plane angled about 20° up from the horizontal. To cut the butt 20, the other saw blade will have to be adjusted about plus 90° relative to the one saw blade, or in sum to about a 110° angle if measured from the same horizon as used to measure the 20° angle. Thus resultant seat 27 and butt 28 intersection is about 90°.

FIG. 2 shows an alternative wooden truss design 30, as for a cathedral ceiling. It comprises an opposite pair of in inclined bottom chords 32 and then a more steeply-inclined opposite pair of top chords 34. FIG. 3 is enlarged view of the top chord 34's bottom end. Like FIG. 1, it comprises a seat 37 and butt 38. Unlike FIG. 1, this top chord 34 further comprises a scarf 39. Now, the aforementioned saw machines have been further adapted to handle this design. That is, in order to maintain optimized mass production, preferably such a saw machine will have three saws instead of two: a first for the seat 37, a second for the butt 38 and the third for the scarf 39.

There are various shortcomings with the prior art saw machines. One is that, if the scarf 39 measures nearly two feet in length (~60 cm), then the circular saw for the scarf cut will have a blade that measures at least five feet in diameter (~150 cm). Other shortcomings include without limitation that circular saws are fairly limited to producing straight line cuts.

It is an object of the invention to overcome various shortcomings with the prior art.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
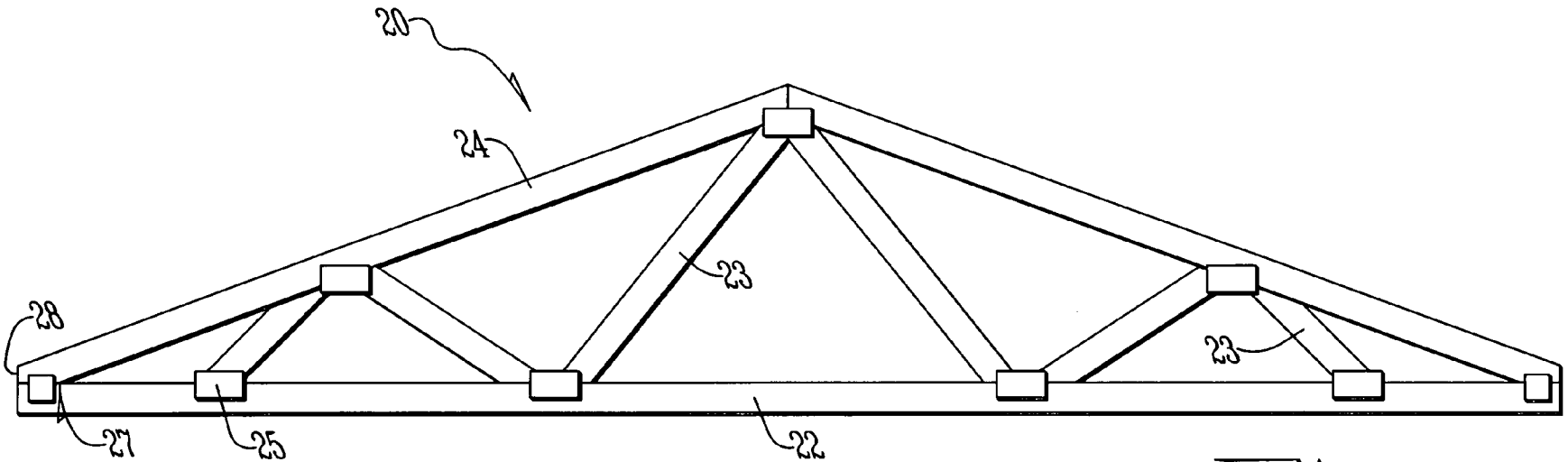
FIG. 1 (Prior Art)
FIG. 1 is an elevational view of a gable truss in accordance with the prior art.
Figure 2:
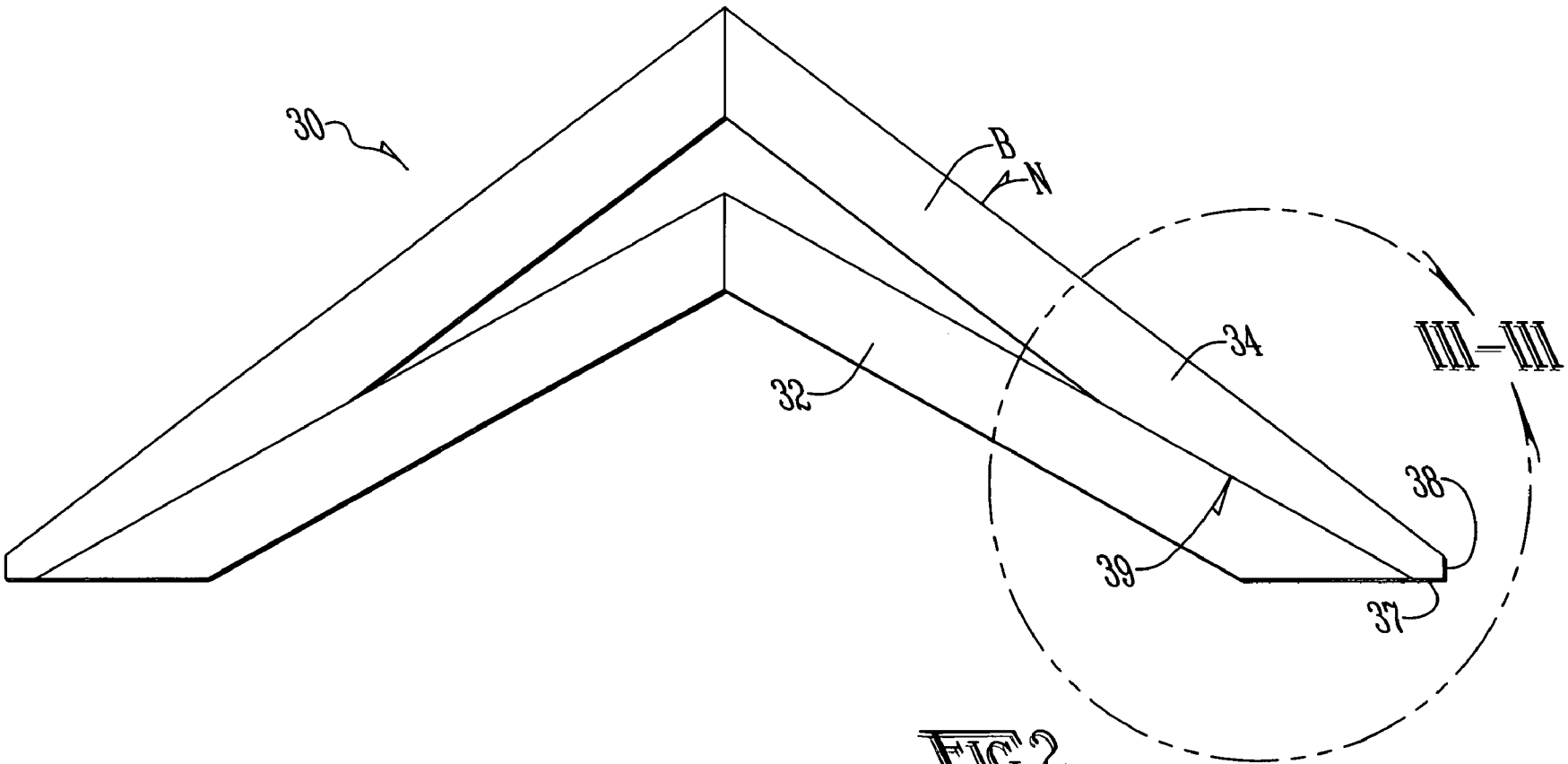
FIG. 2 (Prior Art)
FIG. 2 is an elevational view comparable to FIGURE except showing a cathedral ceiling truss in accordance with the prior art.
Figure 4:
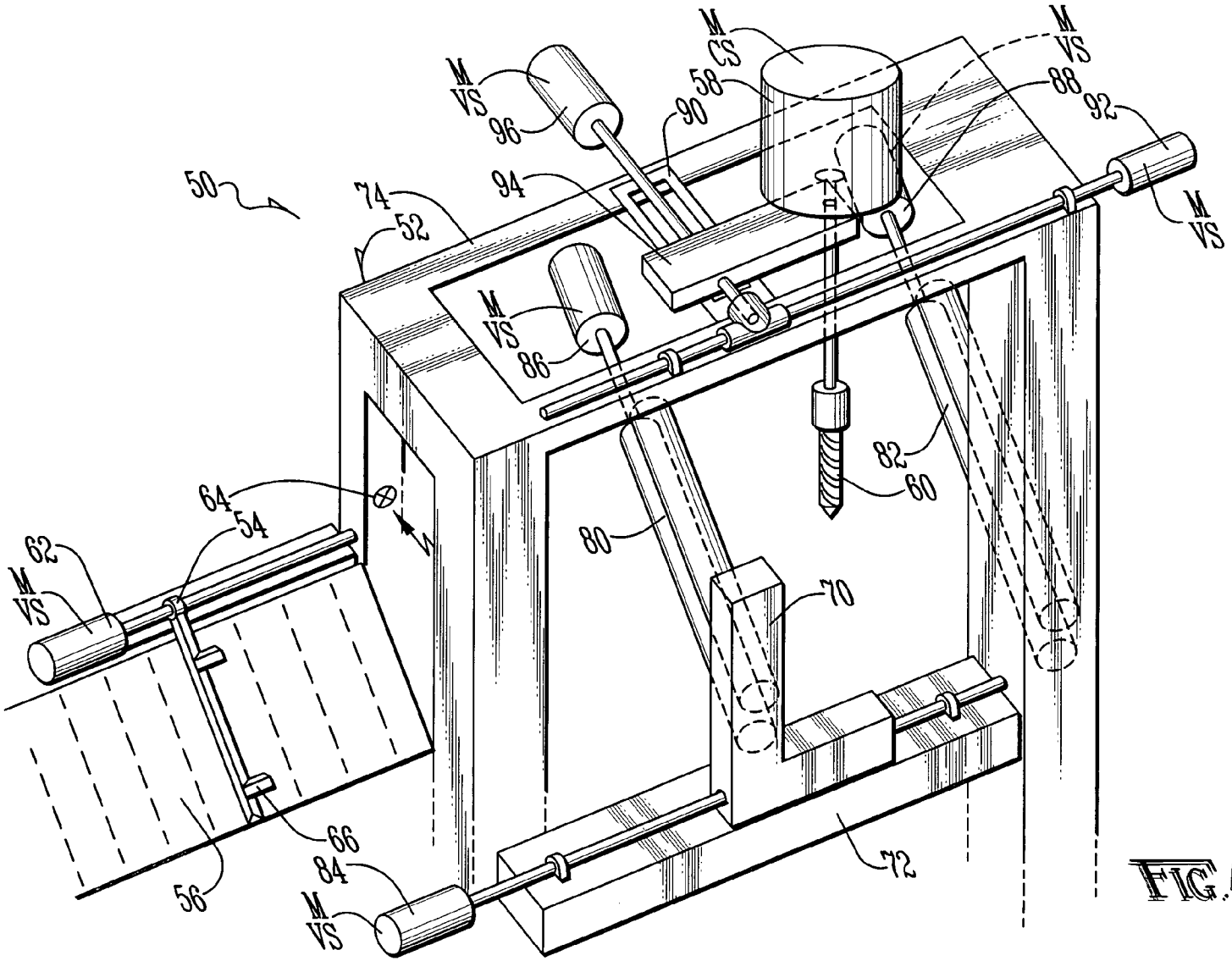
FIG. 4 is a perspective schematic view of a component mill in accordance with the invention, with portions broken away, for producing wooden construction components.

FIG. 4 shows a component mill 50 in accordance with the invention for producing wooden construction components. Briefly, it comprises a main stand 52 as well as a combination paddle 54 and roller table 56. In the preferred embodiment of the invention, it comprises several motors:—one high-speed drive motor 58 for rotating the tool bit at cutting speed and then about six servomotors for controlling position(s) of either the tool bit 60 or workpiece (for example and without limitation, top cord 34 in FIG. 2). A computer-implemented control system (not shown) is given the tasks of controlling the feed, cutting, and discharge operations for an endless succession of workpieces through various communications comprising instructions distributed among the various servomotors. The tool-bit drive motor 58 is more likely configured to accept only ON and OFF instructions.

The tool bit 60 comprises for example a wood end mill. In this illustration, it has two helical flutes with serrations on their lands. The tool bit 60 is designed to attack the wooden workpieces not with its tip end as by axial strokes like a drill but with its cylindrical lateral side. The high-speed drive motor 58 preferably operates at something like for example 18,000 rpm.

Workpieces (eg., 34) for the inventive component mill typically comprise at least lumberyard boards commonplace in the construction industry. For example and without limitation, a typical workpiece might comprise a 2×6 board (eg., 5 cm narrow by 15 cm broad when rough) in about any length between a short extreme described below and a long extreme that is determined by the length more or less of the roller table 56. In a preferred embodiment of the roller table 56, it spans about twenty feet (~6 m) in the longitudinal direction. It is preferred to feed one board to the roller table 56 at a time by an infeed conveyor (not shown), such that the board on the roller table 56 lies flat on one broad side (eg., indicated by character B in FIG. 2), and advances across the roller table 56 down the longitudinal run of the path of conveyance thereof with a front end of the board leading the advance, the opposite trailing end being the back end.

In FIG. 4, the direction of advance (from infeed to discharge) is left to right although, as described more particularly below, at times the mill 50 operates to cycle the workpiece forwards and backwards to achieve certain results. The board will follow a fairly level elevation all the way through the mill 50 until it is discharged, as onto for example a discharge conveyor (not shown). Preferably the board will be neither twisted in its lane of transit along the longitudinal axis, nor swivelled about a vertical axis, during the course of the milling operations. That is, it is preferred if the board is simply advanced and retracted, forwards and backwards in its lane of transit along the longitudinal axis, during milling operations. Moreover, during actual milling operations, much of the board will be suspended in midair. Portions will even be cantilevered into midair.

Hence the board-positioning aspects of the invention include the following. Boards are launched one at a time onto the gravity-feed roller table 56, as by some suitable infeed conveyor (not shown). The roller table 56 is preferably sufficiently long to support all of even the longest boards expected to be workpieces (eg., perhaps twenty feet or ~6 m long). The paddle 54 is driven by a combination servomotor and linear actuator package 62 that moves the paddle 54 forwards or backwards relative the direction of advance, and according to control instructions from the control system (not shown). When a board arrives onto the roller table 56, the paddle 54 is elevated slightly to give the board clearance underneath it, and then moves backwards over the under passing board until it, the paddle 54, clears the back end of the board, after which the paddle 54 will set back down to abut against the board's back end. Then the paddle 54 gently pushes the board forward by the back end until the board's front end abuts a nose actuator (not shown).

The main stand 52 comprises a rear pair of legs and front pair of legs. The rear pair of legs carry a proximity detection system 64 for determining a fairly exact position of the board's front end. The control system stores this position as sort of a "home" position, as for reckoning board position for all further operations. The paddle 54 also has a clamping system 66, comprising opposite jaws which move along the lateral front of the paddle 54 reversibly to and away from each other for squeeze and release strokes. Once the home position is determined by the control system, the clamping system 66 is operated to clamp securely onto the back end of the board so that the paddle 54 is capable of not only pushing the board forwards but also pulling it backwards.

The stand 52 furthermore includes a pair of side tracks 72 (only the near one of the side tracks is illustrated) as well as pair of overhead tracks 74, with each left and right ones of the pairs of tracks 72 and 74 extending between the left and right front and rear legs respectively. The side tracks 72 cooperatively carry a traveling carriage 70 (only a near upright arm and foot of the carriage is illustrated, wherein not illustrated are crosspieces of the carriage 70 as well as the far side counterparts to the near-side upright arm and foot since these have been omitted for convenience of illustration). The upright arms of the traveling carriage 70 support a pair of vertically-stacked pinch rollers 80 between them. These are the input pinch rollers 80, and in contrast to an output pair of pinch rollers 82, which extend between the stand 52's front legs. The pairs of pinch rollers 80 and 82 are covered in resilient sleeves of some suitable polymeric- or resin-based material for good frictional grabbing onto any workpiece which is fed into the mouth or vertical gap between either of the pairs 80 or 82 of the vertically-stacked pinch rollers. Preferably the gap is adjustable in order accept boards of different thicknesses. For each pair of pinch rollers 80 and 82, preferably the elevation for the lower roller is fixed such that its uppermost arch height is co-planar with the plane of conveyance. In contrast, preferably the elevations for the upper rollers are adjustable so that the vertical gap therebetween is adjustable. However, generally during a given job, the milling operations will process board after board in succession for long periods of time, and high numbers of count, such that gap adjustment between the pinch rollers 80/82 is a fairly seldom event.

Preferably the longitudinal position of the output pinch rollers 82 is fixed, such as being stationary between the stand 52's front legs. In contrast, preferably the longitudinal position of the input pinch rollers 80 is adjustable, in fact as carried in a tandem between the arms of the traveling carriage 70. A second combination servomotor and linear actuator package 84 is arranged to drive the traveling carriage 70 backwards and forwards relative the direction of advance. Third and fourth servomotors 86 and 88 are provided to drive the input and output pinch rollers 80 and 82 respectively. Each pair of pinch rollers 80 and 82 are driven counter-rotationally to each other at all times (except of course when held stopped). The pairs of pinch rollers 80 and 82 can be driven at varying speed to accelerate and decelerate the driven workpiece, as well as are instantly reversible in order to change direction of the workpiece from between forwards and backwards or vice versa.

In a preferred embodiment, the furthest that the traveling carriage 70 can be backed away from the output rollers 82 will result in a thirty-nine inch (1 m) span between centers of the input and output pinch rollers 80 and 82. In this furthest back position, the input pinch rollers 80 are about six inches (~15 cm) away from the roller table 56's nose actuator (not shown but, eg., where the board's front end is stopped when originally introduced to the roller table 56). This is a span of six inches (~15 cm) of free air and it corresponds to at least one reckoning of the short extreme for workpieces. More practically however, the short extreme might be some fractional percentage greater than that span.

To turn attention to the overhead tracks 74, they support a traveling gantry 90 which is movable between forwards and backwards directions by another combination servo motor and linear actuator package 92. The gantry 90 carries a traveling slide 94 that is driven laterally left or right across the gantry 90 by an additional combination servo motor and linear actuator package 96. The traveling slide 94 provides a mounting surface for the high-speed tool-bit motor 58. The high-speed tool-bit motor 58 is oriented so that its drive shaft extends straight down along a vertical axis, terminating in a chuck which allows exchange of different tool bits (eg., 60) as desired. Unlike a drill press, there is no provision with the invention to raise or lower the chuck, at least by any significant measure. As stated above, the tool bit 60 is designed to attack workpieces with its lateral cylindrical side, it being dually fluted so it has spiral lands which are serrated. But given the foregoing gantry 90 and slide 94, it is possible to control the X and Y positions of the tool bit 60 in the plane of conveyance by the combination servo motor and linear actuator packages 92 and 96.

Figure 3:
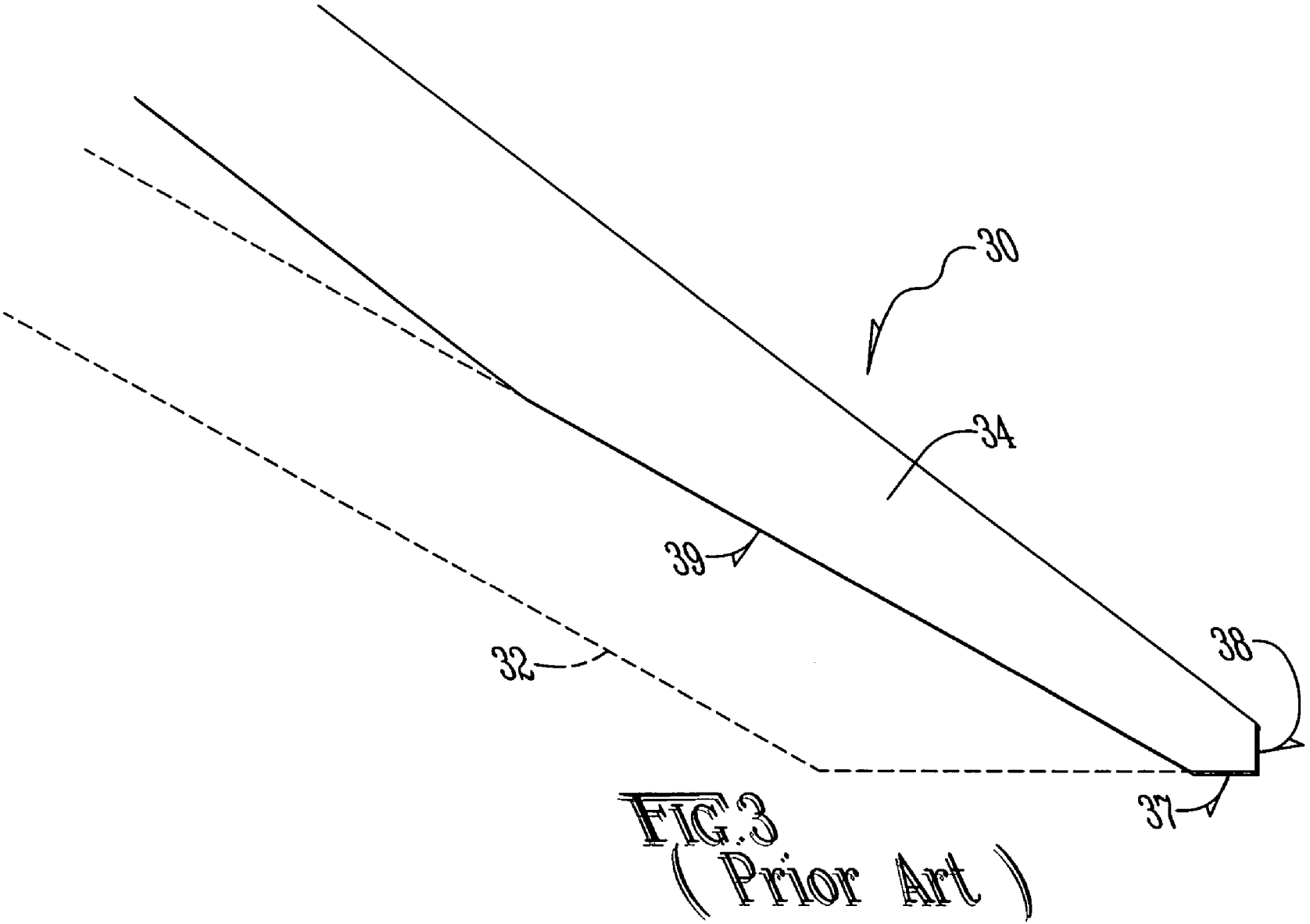
FIG. 3 (Prior Art)
FIG. 3 is an enlarged scale view of detail III in FIG. 2.

In summary, the inventive mill 50 can produce innumerable designs in workpieces. For example, the butt-seat-scarf design 38-37-39 of FIG. 3 can be readily achieved by the following, wherein only three (perhaps as few as two) of the servo motors will be called into service. Originally, the tool bit 60 is moved aside laterally clear of the lane of transit of the board so that the input pinch rollers 80 can drive front end of the board slightly forwards of the tool bit 60's longitudinal position. At this stage, the tool bit 60 is driven by the traveling slide 94 to traverse the lane of transit for the board, and preferably at constant speed. As soon as the tool bit 60 starts to cut into the side of the board, the input pinch rollers 80 are driven to pull the board backwards, and at a constant speed, in order to trace a diagonal line that will form the butt 38. The sequence and timing of the milling operations described next is not accomplished by sensors and feedback but by pre-programmed control routines whose most fundamental input is the home position for each successive workpiece as determined by the proximity detection system 64. As the tool bit 60 traverses to a lateral position that corresponds to the right-angle corner between the butt 38 and seat 37, the input pinch rollers 80 are reversed to change the direction of the board, moving again at a constant speed, except forwards and also at a speed determined by factors independent of the factors which determined the backwards speed for producing the butt line 38. Instead, the speed is selected accordingly in order to trace a line that will correspond to the seat 37. When the tool bit traverses to a further lateral position that corresponds to the intersection between the seat 37 and scarf 39, the input pinch rollers 80 continue advancing the board forwards except at a sped up speed in order to produce the longer diagonal line of the scarf 39. When the tool bit 60 passes through the opposite lateral side of the board, the resultant shape will be the butt-seat-scarf 38-37-39 design of FIG. 3.

Although the description of the above process implicates only two (86 and 96) of the six servo motors (62, 84, 86, 88, 92 and 96), although preferably a third one (eg., 62) is used as well, it being the one that drives the paddle 54. That is, while the input pinch rollers 80 are relied upon to provide fine control over the board's ever-changing longitudinal position, preferably the paddle 54 retains its grip on the back end of the board for positional stability. To do so, the paddle 54 has to travel to and fro with the back end of the board as the input pinch rollers 80 thrust the board forwards and backwards so that the laterally-traversing tool bit 60 traces the correct lines. Hence the paddle 54 prevents the board from tipping or dipping, or the back end from kicking out a little to the left or right. But again, the input pinch rollers 80 are relied upon for the most part to provide fine control over longitudinal position. One advantage of combining pinch rollers 80 and 82 with servo motors 86 and 88 respectively includes that the pinch rollers 80 and 82 can be reversed virtually instantaneously, with almost no apparent hesitancy for a decelerate-stop-accelerate cycle between (i) the instant when one constant speed operation terminates and (ii) the next instant when a succeeding constant speed operation takes over, even if the workpiece is being thrust in the opposite direction. That way, the inventive mill 10 can produce very sharp corners.

The inventive mill 10 can also produce half circles in the ends of boards. Again, the tool bit 60 is driven to traverse laterally at constant speed through the lane of transit of the board. The input pinch rollers 80 manipulate the front end of the board originally so that it is at first pushed past the tool bit 60's traverse path, and then pulled backwards as the tool bit 60 hits the board's first side, pulling the board gradually slower to a stop and then accelerating the board forwards so that, by this means, a smooth half circle is formed on the front end of the board.

As soon as the front end's work is completed, the input pinch rollers 80 might "hand-off" the board to the output pinch rollers 82, which would discharge the board somewhere, as onto a discharge conveyor (not shown). Alternatively, the input and output rollers 80 and 82 can work together and allow the mill 10 to reverse direction and cut a new back end for the workpiece, after which the output pinch rollers 82 can eject the workpiece. In this way, stair stringers can be produced. That is, the input pinch rollers 80 alone (or that is, without assistance from the output pinch rollers 82) manipulate the front end of the board for producing the top step and butt lines, and then thereafter progress to shaping the intermediate step and riser lines in a process which eventually requires the output pinch rollers 82 to work cooperatively with the input pinch rollers 80, ultimately until the board passes past the input pinch rollers 80 such that the output pinch rollers 84 have sole control for completing the job, including production of the bottom seat and butt lines.

Throughput aside (ie., feed rates for saws are indeed faster), the invention provides several other advantages over saw machines. The inventive mill 50 is more accurate. There is no counterpart problem to the problem of deflection of saw blades. Additionally, the inventive mill 50 is not confined to the "two blades, two cuts," "three blades, three cuts" (and so on) equation that saw machines are confined to. Also, the inventive mill 50 can produce curved lines.

The inventive mill 50 is compact. It has a smaller "foot print" in a factory, which means that it requires a whole lot less floor space. The inventive mill 50 minimizes waste. The scraps are just small odds and ends. Scraps aside, it only otherwise outputs shavings—and not sawdust—and, in contrast to sawdust, there is a good market for shavings.

The inventive mill 50 is quieter. On a comparative basis, the inventive mill 50 might produce about an 81 db work environment, whereas a saw machine will produce about a 94 db work environment. That's because here are no big sixteen inch (~40 cm) and thirty inch (~75 cm) diameter saw blades whirring about at 3,600 rpm. For the same reasons, the inventive mill 50 is safer.

Moreover, the inventive mill 50 affords economies over saw machines. At the time of this writing, a replacement tool bit 60 costs about US$12.00. In contrast, a replacement sixteen inch (~40 cm) diameter saw blade costs about US$170.00, while a replacement for thirty inch (~75 cm) diameter saw blade costs about US$500.00.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A method of milling wooden construction components out of stock boards that are elongated between spaced ends and have planar broad sides spaced by planar edges, comprising the steps of:

launching a board forward in a planar longitudinal lane of transit, with one end of the board leading, the other end of the board trailing, and one broad side of the board traveling in the lane of transit in order to present one edge of the board for milling;

pinching the board's broad sides between a pair of pinch rollers that extend laterally across the lane of transit, wherein said pinch rollers are driven counter-rotationally to each other and are reversible so as to alternately cycle the board in advancing and retracting strokes or else hold the board stopped;

keeping the board straight in the lane of transit;

providing a traversing end-mill bit that spins on a spin axis wherein said spin axis is generally perpendicular to the board's broad sides and is reversibly traversable across the lane of transit forward of the pinch rollers; and milling a new edge into the board by advancing, retracting or stopping the board simultaneously with traversing the end-mill bit across the lane of transit wherein, if the board is advancing or retracting simultaneously with the end-mill bit traversing the board, then a resulting milled edge in the board extends along not a straight lateral or straight longitudinal line but either a diagonal or curved line;

wherein the step of keeping the board straight further comprises releasably clamping the board proximate the rear end thereof by a longitudinally-traveling clamp and then releasing the board at some stage, followed by the clamp traveling rearward to clamp on a succeeding board and repeating the step of launching with the succeeding board.

2. The method of claim 1 further comprising pinching the board's broad sides between another pair of pinch rollers longitudinally-spaced forward of said one pair of pinch rollers and comparably extending laterally across the lane of transit, and which are driven in tandem with said one pair of pinch rollers to assist in keeping the board straight as well as to discharge the board.

3. The method of claim 1 further comprising the provision of at least one traveling carriage comprising arms flanking the lane of transit and carrying therebetween said one pair of pinch rollers and driven for rearward and forward movement in the longitudinal direction to assist in the step of launching.

4. The method of claim 1 further comprising the provision of another traveling carriage carrying the clamp, and driven for rearward and forward movement in the longitudinal direction so that the steps of advancing, retracting or stopping the board can be carried out either by the pinch rollers, said other traveling carriage, or all in coordination together.

5. A method of milling wooden construction components out of stock boards that are elongated between spaced ends and have planar broad sides spaced by planar edges, comprising the steps of:

launching a board forward in a planar longitudinal lane of transit, with one end of the board leading, the other end of the board trailing, and one broad side of the board traveling in the lane of transit in order to present one edge of the board for milling;

pinching the board's broad sides between a pair of pinch rollers that extend laterally across the lane of transit, wherein said pinch rollers are driven counter-rotationally to each other and are reversible so as to alternately cycle the board in advancing and retracting strokes or else hold the board stopped;

keeping the board straight in the lane of transit;

providing a traversing end-mill bit that spins on a spin axis wherein said spin axis is generally perpendicular to the board's broad sides and is reversibly traversable across the lane of transit forward of the pinch rollers; and milling a new edge into the board by advancing, retracting or stopping the board simultaneously with traversing the end-mill bit across the lane of transit wherein, if the board is advancing or retracting simultaneously with the end-mill bit traversing the board, then a resulting milled edge in the board extends along not a straight lateral or straight longitudinal line but either a diagonal or curved line;

wherein the step of milling a new edge into the board comprises at least one advancing stroke and at least one retracting stroke with the end-mill bit operatively milling the new edge.

6. A method of milling wooden construction components out of stock boards that are elongated between spaced ends and have planar broad sides spaced by planar edges, comprising the steps of:

launching a board forward in a planar longitudinal lane of transit, with one end of the board leading, the other end of the board trailing, and one broad side of the board traveling in the lane of transit in order to present one edge of the board for milling;

pinching the board's broad sides between a pair of pinch rollers that extend laterally across the lane of transit, wherein said pinch rollers are driven counter-rotationally to each other and are reversible so as to alternately cycle the board in advancing and retracting strokes or else hold the board stopped;

keeping the board straight in the lane of transit;

providing a traversing end-mill bit that spins on a spin axis wherein said spin axis is generally perpendicular to the board's broad sides and is reversibly traversable across the lane of transit forward of the pinch rollers; and milling a new edge into the board by advancing, retracting or stopping the board simultaneously with scrolling the end-mill bit to include not only reversibly traversing across the lane of transit laterally but also reversibly transiting longitudinally between forward and rearward extremes wherein the end-mill bit can not only reversibly traverse across the lane of transit but also zigzag forward or rearward therein between said extremes;

wherein, if the board is advancing or retracting simultaneously with the end-mill bit traversing the board, then a resulting milled edge in the board extends along not a straight lateral or straight longitudinal line but either a diagonal or curved line.

7. The method of claim 6 wherein the step of milling a new edge into the board comprises at least one advancing stroke and at least one retracting stroke with the end-mill bit operatively milling the new edge.

* * * * *